US011926356B1

(12) United States Patent
Wang et al.

(10) Patent No.: US 11,926,356 B1
(45) Date of Patent: Mar. 12, 2024

(54) METHOD AND DEVICE FOR MULTI-TRAIN OPERATION TREND DEDUCTION

(71) Applicants: CHINA ACADEMY OF RAILWAY SCIENCES CORPORATION LIMITED SIGNAL & COMMUNICATION RESEARCH INSTITUTE, Beijing (CN); BEIJING HUATIE INFORMATION TECHNOLOGY Co., Ltd., Beijing (CN); CHINA ACADEMY OF RAILWAY SCIENCES CORPORATION LIMITED, Beijing (CN); BEIJING RUICHI NATIONAL RAILWAY INTELLIGENT TRANSPORT SYSTEM ENGINEERING TECHNOLOGY Co., Ltd., Beijing (CN)

(72) Inventors: Rongsheng Wang, Beijing (CN); Qi Zhang, Beijing (CN); Zhiming Yuan, Beijing (CN); Tao Zhang, Beijing (CN); Tao Wang, Beijing (CN); Shuxin Ding, Beijing (CN)

(73) Assignees: CHINA ACADEMY OF RAILWAY SCIENCES CORPORATION LIMITED SIGNAL & COMMUNICATION RESEARCH INSTITUTE, Beijing (CN); BEIJING HUATIE INFORMATION TECHNOLOGY Co., Ltd., Beijing (CN); CHINA ACADEMY OF RAILWAY SCIENCES CORPORATION LIMITED, Beijing (CN); BEIJING RUICHI NATIONAL RAILWAY INTELLIGENT TRANSPORT SYSTEM ENGINEERING TECHNOLOGY Co., Ltd., Beijing (CN)

( * ) Notice: Subject to any disclaimer, the term of this patent is extended or adjusted under 35 U.S.C. 154(b) by 0 days.

(21) Appl. No.: 18/148,634

(22) Filed: Dec. 30, 2022

(30) Foreign Application Priority Data

Sep. 13, 2022 (CN) ..... 202211107489.3

(51) Int. Cl.
*B61L 27/00* (2022.01)
*B61L 27/12* (2022.01)
*B61L 27/16* (2022.01)

(52) U.S. Cl.
CPC ..... *B61L 27/16* (2022.01); *B61L 27/12* (2022.01)

(58) Field of Classification Search
None
See application file for complete search history.

(56) References Cited

U.S. PATENT DOCUMENTS

2022/0188725 A1* 6/2022 Minakawa ..... G06Q 10/06311

FOREIGN PATENT DOCUMENTS

CN 113562039 A 10/2021
CN 114298398 A 4/2022
(Continued)

OTHER PUBLICATIONS

Search Report dated Oct. 21, 2022, in corresponding Chinese Application No. 202211107489.3, 2 pages.
(Continued)

*Primary Examiner* — Adam D Tissot
(74) *Attorney, Agent, or Firm* — Maier & Maier, PLLC

(57) ABSTRACT

A method and device of multi-train operation trend deduction. Temporary speed limit information, scheduling information, line information and train status information are obtained; the coupling relationship between the trains trac-
(Continued)

tion calculation and the area of space-time scope which is under temporary speed limit are analyzed, and the time saving driving strategy of the first train within the time domain is calculated; according to the running position and speed of the front train, a multi-train operation tracking model under different block systems is established; according to the temporary speed limit information, the driving strategy of following tracking train is deduced, and the operation of the multi-train is calculated; the operation trend of multi-train to the driving scheduling platform is sent.

10 Claims, 6 Drawing Sheets

(56) References Cited

FOREIGN PATENT DOCUMENTS

| | | | |
|---|---|---|---|
| CN | 114475726 | A | 5/2022 |
| CN | 114771607 | A | 7/2022 |
| JP | 200791178 | A | 4/2007 |

OTHER PUBLICATIONS

Office Action dated Oct. 21, 2022, in corresponding Chinese Application No. 202211107489.3, 10 pages.
Notification to Grant Patent Right for Invention dated Oct. 29, 2022, in corresponding Chinese Application No. 202211107489.3, 3 pages.

* cited by examiner

METHOD AND DEVICE FOR MULTI-TRAIN OPERATION TREND DEDUCTION

FIELD

The present invention involves the field of railway transportation and management and specifically involves a multi-train operation trend deduction method and device.

BACKGROUND

At present, China has fully established a "four vertical and four horizontal" high-speed rail network. Under network operation conditions, when the external emergencies affect the running of the train, the dispatcher needs to estimate the train operation situation and adjust the stage plan timely according to the on-way information, for example, the static environment of the line, the running status of the train, etc, the train driver formulate driving strategy according to the stage plan. Among them, the running status of the train refers to the dynamic information in the future operation of the train, for example, the acceleration, speed, passing time, interval operation time, and delay time of the station, etc. It is one of the important basis for the scheduling staff to adjust the driving strategy and for formulating driving strategy. However, when facing the dynamic strongly and multi-source on-way information, the dispatcher is difficult to accurately decouple multi-train tracking, correlation between space-time scope and emergencies which is under regional temporary speed limit, to adjust the stage plan timely, scientifically, and reasonably. The train operation order is difficult to recover in a short period of time, which seriously affects the safe and efficient operation of the railway; the coupling calculation of the regional temporary speed limit under the emergencies of the incident is relatively large needs long time to generate the stage plan, which makes it difficult for the train operation order to recover in a short period of time, which seriously affects the safe and efficient operation of the railway. It is urgent to improve a scientific and efficient multi-train operation trend in real time.

SUMMARY

The purpose of the present invention is to provide a method and device for multi-train operation trend to solve the problems raised in the above background technology.

The present invention provides a method of developing a multi-train operation trend, including the following steps:

step S1: get temporary speed limit information, scheduling information, line information and train status information;

step S2: determine the coupling relationship between the train's traction calculation and the area of space-time scope which is under temporary speed limit, and calculate the time saving driving strategy of the first train within the time domain, step S2 includes specifically calculating multi-train operation trend information, in order to get acceleration, speed, and passing time of the train in the interval;

Step S3: according to the running position and speed of the front train, establish a multi-train operation tracking model under different block systems;

the step S3 specifically includes:

the multi-train operation tracking model under different block systems includes:

the calculation formula of $$x_{g+1,\tau}^{EOA}$$

and $$v_{g+1,\tau}^{EOA}$$

under quasi moving block is:

$$\begin{cases} x_{g+1,\tau}^{EOA} = x_{g,\tau-1} - L_{train} - L_{block} - L_{safe} \\ v_{g+1,\tau}^{EOA} = 0 \end{cases} \tag{1}$$

the calculation formula of $$x_{g+1,\tau}^{EOA}$$

and $$v_{g+1,\tau}^{EOA}$$

under moving block-absolute braking is:

$$\begin{cases} x_{g+1,\tau}^{EOA} = x_{g,\tau-1} - L_{train} - L_{safe} \\ v_{g+1,\tau}^{EOA} = 0 \end{cases} \tag{2}$$

the calculation formula of $$x_{g+1,\tau}^{EOA}$$

and $$v_{g+1,\tau}^{EOA}$$

under moving block-relative braking is:

$$\begin{cases} x_{g+1,\tau}^{EOA} = x_{g,\tau} - L_{train} - L_{safe} \\ v_{g+1,\tau}^{EOA} = 0 \end{cases} \tag{3}$$

the calculation formula of $$x_{g+1,\tau}^{EOA}$$

and $$v_{g+1,\tau}^{EOA}$$

under virtual marshalling is:

$$\begin{cases} x_{g+1,\tau}^{EOA} = x_{g,\tau} - L_{train} - L_{safe} \\ v_{g+1,\tau}^{EOA} = v_{g,\tau}^{EOA} \end{cases} \quad (4)$$

among them, $$x_{g+1,\tau}^{EOA}$$

and $$v_{g+1,\tau}^{EOA}$$

represent End of Authority (EOA), a location to which a train is authorized to move, and the speed at the position of the EOA of the train g+1 at the current moment τ respectively, $$v_{g,\tau}^{EOA}$$

represents the speed at the position of the EOA of the train g at the current moment τ, $x_{g,\tau}$ represents the position of the train g at the current moment τ, $x_{g,\tau-1}$ represents the position of the train g at the moment τ−1, $L_{safe}$ is the distance of safety protection, $L_{block}$ is the distance from the train g ahead to the nearest block district, $L_{train}$ is the length of the train;

step S4: according to the temporary speed limit information, deduce the driving strategy of following tracking train, and calculate the operation of the multi-train;

step S5: send the operation trend of multi-train to the driving scheduling platform.

Preferably, the step S2 specifically includes:

step S2-1: calculate the running acceleration under the traction state;

step S2-2: The first train driving strategy is generated;

the first train driving strategy includes calculating the first time saving driving strategy to get the first train operation trend information, which is starting from the departure station signal machine at the departure station, to the next stop of the station signal machine, the first train operation trend information includes the acceleration, speed, and passing time, the running time at the station, and the delay time arriving station.

Preferably, the step S2-1 specifically includes:

the running acceleration under the traction state is:

$$a = \frac{n_1 \cdot F_{max} - n_2 \cdot B_{max} - R(v) - W}{m} \quad (5)$$

in the formula: $F_{max}$ and $B_{max}$ represent respectively the maximum traction and maximum brake power of the train; $n_1$, $n_2$ are state parameters, the combination of $n_1$, $n_2$ determines the operating conditions of the train, which include traction, cruise, lazy line, and brake; R(v) represents the basic resistance of the train operation, which is related the speed of the train v; W represents the additional resistance of the train operation, including the ramp additional resistance, curve additional resistance, and tunnel additional resistance, m is the quality of the train.

Preferably, the step S2-2 specifically includes:

the calculation formulas of the running acceleration $a_{g,j}$, speed $v_{g,j}$ and passing time $t_{g,j}$ at the current position of train g are as follow:

$$a_{g,j}=\min\{a, a_{max}\delta_{max}\cdot t_{g,j-1}+a_{g,j-1}\} \quad (6)$$

$$v_{g,j} = \min\left\{V_k, \sqrt{(v_{g,j-1})^2 + 2\cdot a_{g,j}\cdot \Delta j}\right\} \quad (7)$$

$$t_{g,j} \doteq t_{g,j-1} + \Delta t_{g,j-1,j} = t_{g,j-1} + \frac{v_{g,j} - v_{g,j-1}}{a_{g,j}} \quad (8)$$

among them, a represents running acceleration in the traction state of the train, $a_{max}$ represents maximum acceleration, $\delta_{max}$ represents the maximum acceleration change rate, $t_{g,j-1}$ represents the passing time of the train g at the position j−1; $a_{g,j-1}$ represents the running acceleration of the train g at the position j−1; $V_k$ represents the speed limit value of the train in the current speed limit section, $v_{g,j}$ is the speed of train g at the current position j, $v_{g,j-1}$. represents the speed of the train g at the position j−1, Δj represents the distance step length when updating the train position, $\Delta t_{g,j-1}$, represents the running time from the position j−1 to the position j of the train g;

the predictive delay time $w_{g,i+1}$ of the train g arrives at the station i+1 is $$w_{g,i+1}=\Delta t_{,i,i+1}-\Delta \bar{t}_{g,i,i+1} \quad (9)$$

in the formula, $\Delta t_{g,i,i+1}$ is the running time of the train g from the station i to the station i+1, $\Delta \bar{t}_{g,i,i+1}$ is the graph of the fixed range running time of the train g in the interval (i,i+1).

Preferably, the step S4 specifically includes:

if the temporary speed limit does not affect the operation of the tracking train, under the constraints of the block system EOA, the driving strategy of tracking train can directly read the saving time driving strategy of the first train under the condition of no temporary speed limit conditions; if the tracking train is affected by the temporary speed limit, the inspirational rules are performed to calculate the driving strategy of the tracking train.

Preferably, determine whether the temporary speed limit affects the following tracking train, if the current moment r is in the speed limit section $[t_{left}^k, t_{right}^k]$, calculate the EOA position $$x_{g+1,\tau}^{EOA}$$

of the tracking train g+1 at the current moment τ, $$x_{g+1,\tau}^{EOA}$$

is in the range of the spatial scope $[x_{left}^k, x_{right}^k]$, the tracking train will be affected by temporary speed limit; if it is not in the range of the spatial scope, the tracking train will not be affected by temporary speed limit; k represents the speed limit section k, $[t_{left}^k, t_{right}^k]$ represents the time range of the speed limit section k, $[x_{left}^{k}, x_{right}^{k}]$ represents the spatial range of the speed limit section k.

Preferably, the inspirational rules are performed to calculate the driving strategy of the tracking train includes:

step S4-1-1: from $x_{g+1,\tau}$ to $x_{g+1,\tau}^{EOA}$, calculate the maximum traction-cruise driving strategy of the tracking train g+1 which is not affected by the temporary speed limit, by applying saving time driving strategy solution method in step S2-2, wherein $x_{g+1,\tau}$ is the position of the train g+1 at the current time τ, $$x_{g+1,\tau}^{EOA}$$

is the EOA of the train g+1 at the current time τ;

step S4-1-2: from $x_{g+1,\tau}$ to $x_{g+1,\tau}^{EOA}$, calculate the maximum braking-cruise driving strategy of the tracking train g+1 which is affected by the temporary speed limit, by applying saving time driving strategy solution method in step S2-2;

Step S4-1-3: the actual speed of each position at $[x_{g+1,\tau}, x_{g+1,\tau}^{EOA}]$ of the tracking train g+1 is equal to the minimum value between the speed of step S4-1-1 and the speed of step S4-1-2, update the passing time of each position under the tracking train g+1 running with the actual speed.

Preferably, the step S1 specifically includes:

dispatcher sends dispatching order to the wireless block center, and the train dispatching console sends dispatching information to the wireless block center; the dispatching order includes temporary speed limit information, line information and train status information, the dispatching information at least includes the time of receiving and departure, departure sequence, and the line information at least includes the station kilometer post, ramp gradient, curvature, air resistance, temporary speed limit and electric phase separation.

Preferably, the step S5 specifically includes:

step S5-1: the RBC decision device outputs multi-train operation trend, the operation trend of multi-train includes at least the acceleration, speed, passing time, interval operation time, and delay time of the train in the future, which is send to the driving scheduling platform by RBC;

step S5-2: the driving scheduling platform can use the lowest boundary of the running plan adjustment plan under the operation trend of multi-train as the final stage adjustment plan, or adjust phase plan according to the lowest boundary;

step S5-3: RBC receives operation data and movement authority from the train, and obtains line parameters from the ground responder;

step S5-4: RBC sends the static data, Movement Authority (MA), permission for the train to move to a specific location with supervision of the permitted speed, and multi-train operation trend within its jurisdiction, each train can control the operation in accordance with the target speed curve under the operation trend of multi-train or adjust the driving strategy slightly according to the curve.

The present invention also provides a multi-train operation trend deduction device, characterized including the scheduling command module and the train operation control system.

the scheduling command module includes:

acquisition module, to get temporary speed limit information, scheduling information, line information and train status information;

deduction module, to analyze the coupling relationship between the trains traction calculation and the area of space-time scope which is under temporary speed limit, and calculate the time saving driving strategy of the first train within the time domain; and establish a multi-train operation tracking model under different block systems, according to the running position and speed of the front train; and according to the temporary speed limit information, deduce the driving strategy of following tracking train, and calculate the operation of the multi-train;

the multi-train operation tracking model under different block systems includes:

the calculation formula of $$x_{g+1,\tau}^{EOA}$$

and $$v_{g+1,\tau}^{EOA}$$

under quasi moving block is:

$$\begin{cases} x_{g+1,\tau}^{EOA} = x_{g,\tau-1} - L_{train} - L_{block} - L_{safe} \\ v_{g+1,\tau}^{EOA} = 0 \end{cases} \tag{10}$$

the calculation formula of $$x_{g+1,\tau}^{EOA}$$

and $$v_{g+1,\tau}^{EOA}$$

under moving block-absolute braking is:

$$\begin{cases} x_{g+1,\tau}^{EOA} = x_{g,\tau-1} - L_{train} - L_{safe} \\ v_{g+1,\tau}^{EOA} = 0 \end{cases} \tag{11}$$

the calculation formula of $$x_{g+1,\tau}^{EOA}$$

and $$v_{g+1,\tau}^{EOA}$$

under moving block-relative braking is:

$$\begin{cases} x_{g+1,\tau}^{EOA} = x_{g,\tau} - L_{train} - L_{safe} \\ v_{g+1,\tau}^{EOA} = 0 \end{cases} \quad (12)$$

the calculation formula of $$x_{g+1,\tau}^{EOA}$$

and $$v_{g+1,\tau}^{EOA}$$

under virtual marshalling is:

$$\begin{cases} x_{g+1,\tau}^{EOA} = x_{g,\tau} - L_{train} - L_{safe} \\ v_{g+1,\tau}^{EOA} = v_{g,\tau}^{EOA} \end{cases} \quad (13)$$

among them, $$x_{g+1,\tau}^{EOA}$$

and $$v_{g+1,\tau}^{EOA}$$

represent EOA and the speed at the position of the EOA of the train g+1 at the current moment $\tau$ respectively, $$v_{g,\tau}^{EOA}$$

represents the speed at the position of the EOA of the train g at the current moment $\tau$, $x_{g,\tau}$ represents the position of the train g at the current moment $\tau$, $x_{g,\tau-1}$ represents the position of the train g at the moment $\tau-1$, $L_{safe}$ is the distance of safety protection, $L_{block}$ is the distance from the train g ahead to the nearest block district, $L_{train}$ is the length of the train;

sending module, to send the operation trend of multi-train to the driving scheduling platform;

the train operation control system is used control the running of the train according to the multi-train operation trend.

The invention provides a multi-train operation trend deduction method and device. Under the traditional architecture of scheduling command and the running control system of the train, build an information interaction process, analyze the mechanism of coupling in time and space under the speed limit of regional temporary speed limit and analyze multi-train's tracking. The embodiments propose the multi-train operation trend deduction method under different block system, provide a basis for the scheduling regulatory adjustment phase plan and for the train driver to formulate driving strategies, reduce the dependence of human experience in the process of dispatch adjustment, and improve the scientific nature of operation adjustment.

DETAILED DESCRIPTION

Figure 1:
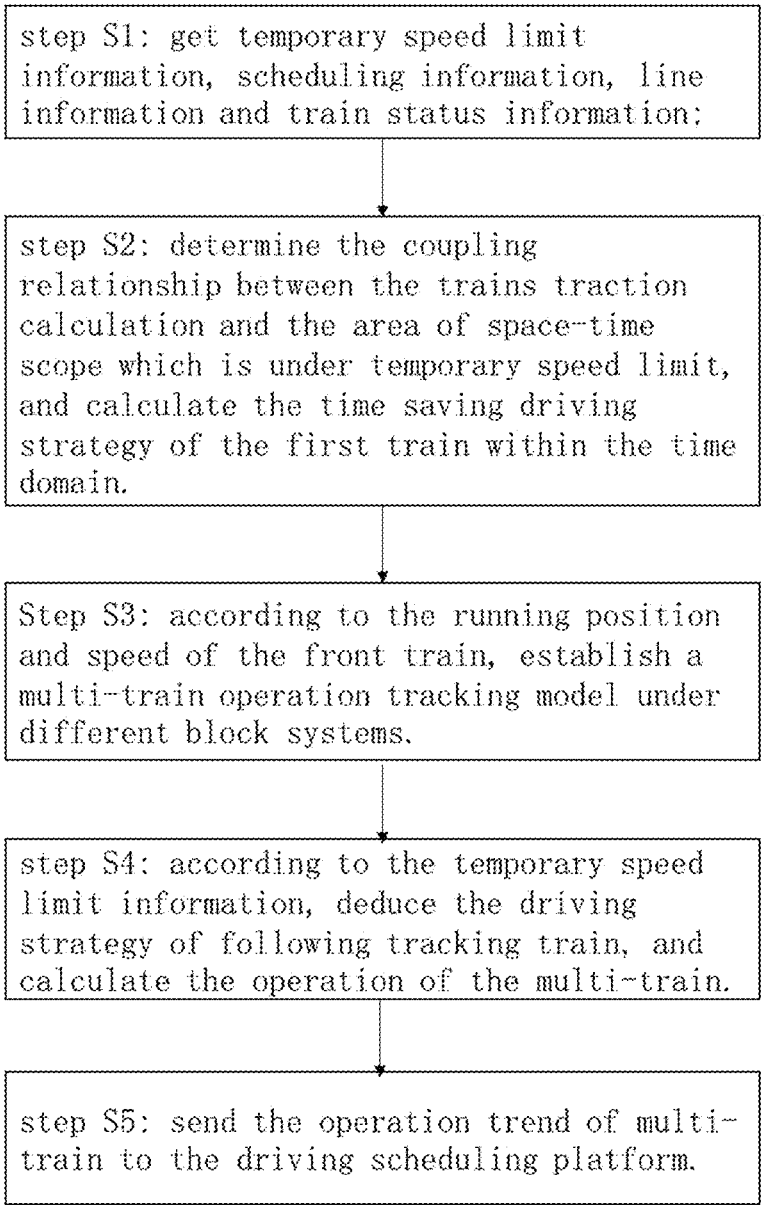
FIG. 1 depicts a process schematic diagram of multi-train operation trend deduction methods.

The following will be clear and complete to the technical solutions of the present invention in conjunction with the attachment. Obviously, the embodiment described is part of the embodiments of the invention, not all embodiments.

The components of the embodiments described and displayed in the drawing here are usually arranged and designed by various configurations. Therefore, the detailed description of the embodiments of the present invention provided in the attachment below does not mean to limit the scope of the present invention that requires protection, but only the selection embodiment of the invention.

Based on the embodiments in the present invention, all other embodiments obtained by ordinary technical personnel in the art under the premise of not creating creative labor belong to the protection of the present invention.

The following combined with the attachment, the technical solution of the present invention further explains.

Figure 2:
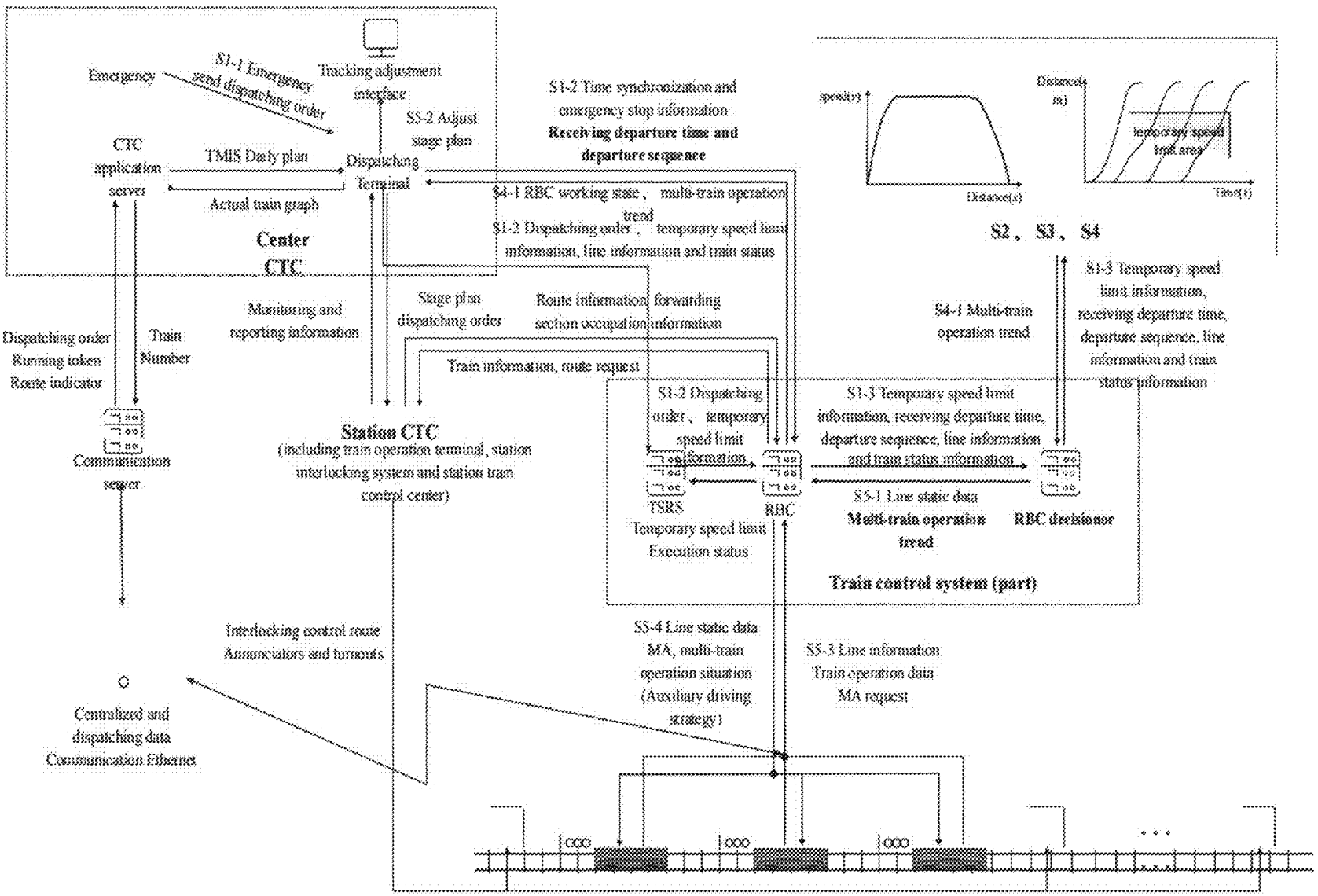
FIG. 2 depicts an information interactive process diagram of the multi-train running trend deduction method.

In the existing technology, the railway signal system mainly relies on the experience of dispatching personnel to estimate the operation trend of the train, to adjust the driving strategy of the train, therefore, the efficiency of the train control is low. As in FIG. 1, the present invention provides a multi-train operation trend deduction method. The information interactive process diagram of the multi-train running trend deduction method as shown in FIG. 2. A multi-train operation trend deduction method includes the following steps:

Step S1: Receive temporary speed limit information, scheduling information, line information, and train status information.

Affected by the emergency, the dispatcher sends dispatching order to the wireless block center, and the train dispatching console sends dispatching information to the wireless block center; Among them, the dispatching order includes temporary speed limit information, line information and train status information, the dispatching information at least includes the time of receiving and departure, departure sequence, and the line information at least includes the station kilometer post, ramp gradient, curvature, air resistance, temporary speed limit and electric phase separation.

Specifically, when different types of emergencies such as natural factors, train faults or passenger flow changes occur, the scheduling officer issues dispatching orders in a targeted manner, which are based on rules and regulations, such as technical regulations, scheduling regulations, and non-normal driving emergency response plans, etc. The command is sent to the Radio Block Center (RBC) by the Temporary Speed Limit Server (TSES), and the RBC forwards the above information to the RBC decision device.

When obtaining information, the present invention realizes the perception and integration of the trains and line static data under different types of emergencies and solves the problem of poor use of the information utilization rate of traditional railway signal system.

Step S2: Analyze the coupling relationship between the train's traction calculation and the area of space-time scope which is under temporary speed limit and calculate the time saving driving strategy of the first train within the time domain. Step S2 includes calculating multi-train operation trend information, in order to provide the train operation information such as acceleration, speed, and passing time in the interval for the dispatcher adjusting phase plan.

Step S2-1: calculate the running acceleration in the traction state.

The running acceleration is:

$$a = \frac{n_1 \cdot F_{max} - n_2 \cdot B_{max} - R(v) - W}{m} \tag{14}$$

In the formula: $F_{max}$ and $B_{max}$ represent respectively the maximum traction and maximum brake power of the train, which can be calculated based on the characteristic curve of traction and braking of an Electric Multiple Unit (EMU); $n_1$, $n_2$ are state parameters, the combination of $n_1$, $n_2$ determines the operating conditions of the train, which include traction (n 1=, $n_2$=0), cruise ($n_1 \in (0, 1)$, $n_2$=0), lazy line ($n_1$=0, $n_2$=0), and brake ($n_1$=0, $n_2$=1); R(v) represents the basic resistance of the train operation, which is related the speed of the train v; W represents the additional resistance of the train operation, including the ramp additional resistance, curve additional resistance, and tunnel additional resistance, which are calculated respectively based on the slope, curve radius, and tunnel length, m is the quality of the train.

Step S2-2: The first train driving strategy is generated.

$g \in \{1, 2, \ldots, G\}$ represents the train g, the station is expressed as $i \in \{1, \ldots, I\}$, the location of the train is expressed as $j \in \{1, \ldots, J\}$, the speed limit section is represented as $k \in \{1, \ldots, K\}$, G, I, J and K indicate respectively the total number of trains, stations, position points and speed limit sections.

Because the goal of the railway operations is minimizing the delay time of the train, the time saving driving strategy is selected as the first train driving strategy. The first train is the first train within the time of the time domain, there is no running train in front. The end of authority (EOA) tracked by the first train is always the location of the receiving route annunciator at the front stop station. Train driving strategy includes calculating the first train operation trend information, which is starting from the departure station signal machine at the departure station, to the next stop of the station signal machine. The first train operation trend information includes the acceleration, speed, and passing time at the position j (j=1, 2, . . . , J−1, J), the running time from the station I to the station i+1, and the delay time arriving station i+1. The speed limit value of the train in the current speed limit section and the next speed limit section are $V_k$ and $V_{k+1}$ respectively, the speed of train g at the current position j is $v_{g,j}$, among them, the train is the first train within the current time domain, the calculation process is as shown in FIG. 3.

Figure 3:
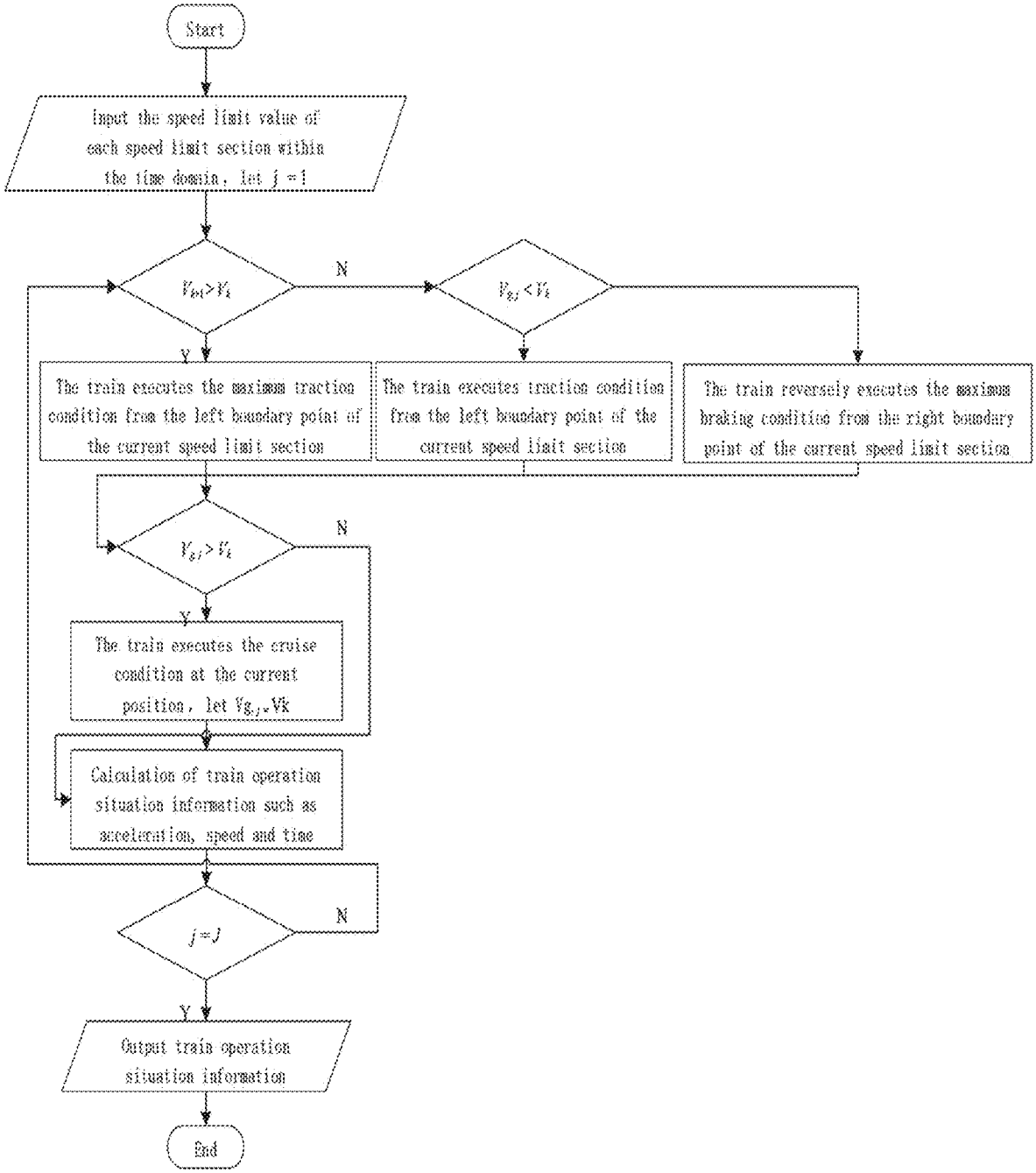
FIG. 3 depicts a process diagram of the time saving driving strategy calculation during the first train.

In FIG. 3, when the running speed $v_{g,j}$ of the train g is greater than $V_k$ at the position j, the train will perform the cruise conditions, letting $v_{g,j}=V_k$.

The calculation formulas of the running acceleration $a_{g,j}$, speed $v_{g,j}$ and passing time $t_{g,j}$ at the current position of train g are as follow:

$$a_{g,j}=\min\{a, a_{max}, \delta_{max} \cdot t_{g,j-1} + a_{g,j-1}\} \tag{15}$$

$$v_{g,j} = \min\left\{V_k, \sqrt{(v_{g,j-1})^2 + 2 \cdot a_{g,j} \cdot \Delta j}\right\} \tag{16}$$

$$t_{g,j} \doteq t_{g,j-1} + \Delta t_{g,j-1,j} = t_{g,j-1} + \frac{v_{g,j} - v_{g,j-1}}{a_{g,j}} \tag{17}$$

Among them, a represents running acceleration in the traction state of the train, $a_{max}$ represents maximum acceleration, $\delta_{max}$ represents the maximum acceleration change rate, $t_{g,j-1}$ represents the passing time of the train g at the position j−1; $a_{g,j-1}$ represents the running acceleration of the train g at the position j−1; the running acceleration of the train g at the current position j is also constrained by the maximum acceleration $a_{max}$ and maximum acceleration change rate $\delta_{max}$, which is based on the running acceleration a under the traction state.

$v_{g,j}$ represents the speed of train g at the current position j, which is constrained by the limited speed of the train at current speed limit section; $v_{g,j-1}$ represents the speed of the train g at the position j−1, Δj represents the distance step length when updating the train position, which is a preset value; as an optional example, the distance step is selected based on the specific needs of real-time and solving accuracy.

$\Delta t_{g,j-1,j}$ represents the running time from the position j−1 to the position j, the running time of the train g from the station i to the station i+1 is equal to the sum of the running time of the train in the range of the section distance steps, that is, $$\Delta t_{g,i,i+1} = t_{g,J} = \sum_{j=1}^{J-1} t_{g,j,j+1} \tag{18}$$

The predictive delay time $w_{g,i+1}$ of the train g arrives at the station i+1 is $$w_{g,i+1}=\Delta t_{g,i,i+1}-\Delta \bar{t}_{g,i,i+1} \tag{19}$$

In the formula, $\Delta \bar{t}_{g,i,i,i+1}$ is the graph of the fixed range running time of the train g in the interval (i,i+1).

Step S3: according to the running position and speed of the front train, establish a multi-train operation tracking model under different block systems;

EOA represents the end point of the tracked driving permit, which is the farthest position of the following tracking train allowed to drive. According to the block type, the tracking train tracks the front train by the running position and speed of the current moment at the current moment. $\tau \in \{\tau_{start}, \tau_{start}+1, \ldots, \tau_{start}+\Gamma\}$ represents the current moment, whose time domain range considered is [0, Γ]. Based on the analysis of the coupling relationship between time and space at the time and space range of the temporary speed limit and traction calculation of the train at step S2, the multi-train operation tracking models under different block types are established respectively.

Figure 4:
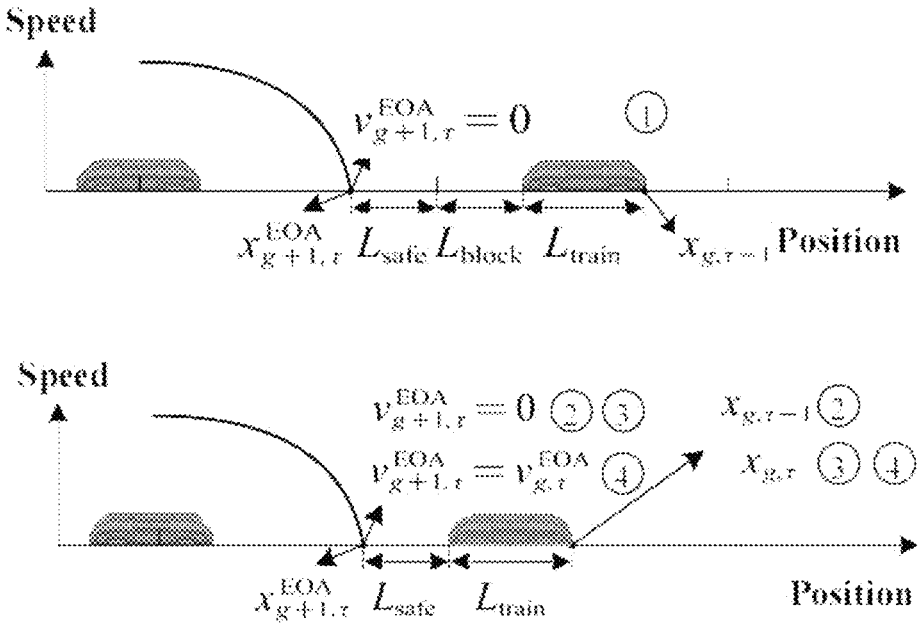
FIG. 4 depicts a schematic diagram of the followed tracking train EOA calculation under different block formulas.

Different block types include four types of block systems, which are quasi moving block, moving block-absolute braking, moving block-relative braking and virtual marshalling, as shown in FIG. 4.

① The calculation formula of $$x_{g+1,\tau}^{EOA}$$

and $$v_{g+1,\tau}^{EOA}$$

under quasi moving block is:

$$\begin{cases} x_{g+1,\tau}^{EOA} = x_{g,\tau-1} - L_{train} - L_{block} - L_{safe} \\ v_{g+1,\tau}^{EOA} = 0 \end{cases} \tag{20}$$

② The calculation formula of $$x_{g+1,\tau}^{EOA}$$

and $$v_{g+1,\tau}^{EOA}$$

under moving block-absolute braking is:

$$\begin{cases} x_{g+1,\tau}^{EOA} = x_{g,\tau-1} - L_{train} - L_{safe} \\ v_{g+1,\tau}^{EOA} = 0 \end{cases} \tag{21}$$

③ The calculation formula of $$x_{g+1,\tau}^{EOA}$$

and $$v_{g+1,\tau}^{EOA}$$

under moving block-relative braking is:

$$\begin{cases} x_{g+1,\tau}^{EOA} = x_{g,\tau-1} - L_{train} - L_{safe} \\ v_{g+1,\tau}^{EOA} = 0 \end{cases} \tag{22}$$

④ The calculation formula of $$x_{g+1,\tau}^{EOA}$$

and $$v_{g+1,\tau}^{EOA}$$

under virtual marshalling is:

$$\begin{cases} x_{g+1,\tau}^{EOA} = x_{g,\tau} - L_{train} - L_{safe} \\ v_{g+1,\tau}^{HOA} = v_{g,\tau}^{HOA} \end{cases} \tag{23}$$

Among them, $$x_{g+1,\tau}^{EOA}$$

and $$v_{g+1,\tau}^{EOA}$$

represent EOA and the speed at the position of the EOA of the train g+1 at the current moment τ respectively, $$x_{g,\tau}^{EOA}$$

and $$v_{g,\tau}^{EOA}$$

represent EOA and the speed at the position of the EOA of the train g at the current moment τ respectively, $x_{g,\tau}$ represents the position of the train g at the current moment τ, $x_{g,\tau-1}$ represents the position of the train g at the moment τ−1, $L_{safe}$ is the distance of safety protection, $L_{block}$ is the distance from the train g ahead to the nearest block district, $L_{train}$ is the length of the train.

The present invention provides tracking models under different block systems, which can be suitable for any railway block system, and establishes absolute braking and relative braking models under mobile block. Compared with the absolute braking model, multi-train tracking efficiency is higher than the relative braking model. Absolute braking is that the following train g+1 tracks the position of the front train g at the time of the previous moment τ−1. The relative braking is that the following train g+1 tracks the position of the front train g at the time of the current moment τ. The virtual marshal is aimed at reducing the tracking interval between multiple trains. While tracing the EOA of the front train, the following train also tracks the operating speed $v_{g,\tau}^{EOA}$ of the front train. Different block systems are adapted to different scenes, improving the applicability of the models, and then improving the applicability of the method of the operation trend.

After establishing the model, the multi-train tracking model may use temporary speed limit information.

Figure 5:
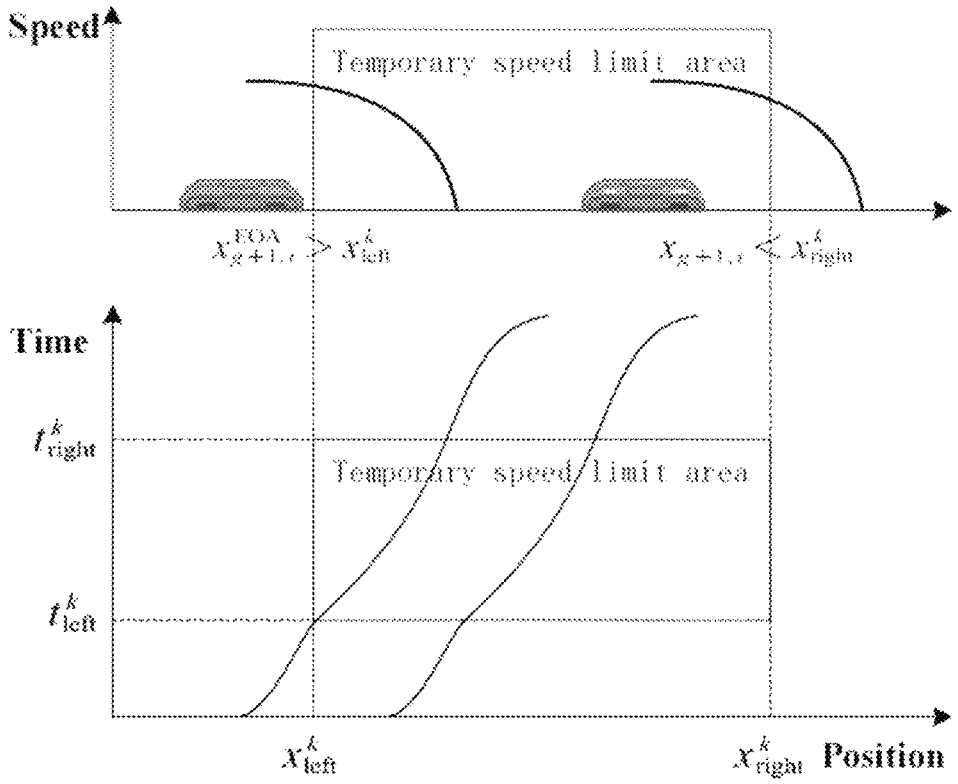
FIG. 5 depicts a schematic diagram of the impact of a temporary speed limit upon a tracking train.

The embodiments determine whether the temporary speed limit affects the following tracking train g+1, as shown in FIG. 5, $$\begin{cases} t_{left}^{k} \leqslant \tau \leqslant t_{right}^{k} \\ x_{g+1,\tau}^{EOA} > x_{left}^{k} \text{或} x_{g+1,\tau} < x_{right}^{k} \end{cases} \tag{24}$$

Among them, k represents the speed limit section k, $[t_{left}^{k}, t_{right}^{k}]$ represents the time range of the speed limit section k, $[x_{left}^{k}, x_{right}^{k}]$ represents the spatial range of the speed limit section k. If the current moment τ is in the speed limit section $[t_{left}^{k}, t_{right}^{k}]$, calculate the EOA position $$x_{g+1,\tau}^{EOA}$$

of the tracking train g+1 at the current moment τ. If $$x_{g+1,\tau}^{EOA}$$

is in the range of the spatial scope $[x_{left}^{k}, x_{right}^{k}]$, the tracking train will be affected by temporary speed limit. The driving strategy of the tracking train will not directly read historical operation data, which needs to be calculated by the inspirational rules of step S4.

After the completion of the EOA calculation, it also includes the calculation results of the RBC based on the EOA calculation results, combined with the front road information and rail circuit segment status sent by the lock system, and tracked the trains to distribute the road to the backward trace.

After the completion of the EOA calculation, it also includes that the RBC distribute the free road to the backward trace according to the calculation results of the RBC and combined with the front road information and rail circuit segment status sent by the lock system.

The present invention provides a multi-train tracking model which is suitable for all block systems. According to whether a temporary speed limit affects tracking trains under different emergencies, it may precisely decouple a connection relation among multi-train tracking and a space-time range under regional temporary speed limit and emergencies.

Step S4: according to the temporary speed limit information, deduce the driving strategy of following tracking train, and calculate the operation of the multi-train; If the temporary speed limit does not affect the operation of the tracking train, under the constraints of the block system EOA, the driving strategy of tracking train can directly read the saving time driving strategy of the first train under the condition of no temporary speed limit conditions, and no re-calculation is required. If the tracking train is affected by the temporary speed limit, the inspirational rules are performed to calculate the driving strategy of the tracking train. Let $x_{g+1,\tau}$ represents the position of the train g+1 at the current moment τ, the inspiration rules of the tracking train driving strategy are calculated as follows:

Step S4-1-1: from $x_{g+1,\tau}$ to $x_{g+1,\tau}^{EOA}$, calculate the maximum traction-cruise driving strategy of the tracking train g+1 which is not affected by the temporary speed limit, by applying saving time driving strategy solution method in step S2-2, wherein $x_{g+1,\tau}$ is the position of the train g+1 at the current time τ;

Step S4-1-2: from $x_{g+1,\tau}^{EOA}$ to $x_{g+1,\tau}$ calculate the maximum braking-cruise driving strategy of the tracking train g+1 which is affected by the temporary speed limit, by applying saving time driving strategy solution method in step S2-2;

Step S4-1-3: the actual speed of each position at $[x_{g+1,\tau}, x_{g+1,\tau}^{EOA}]$ of the tracking train g+1 is equal to the minimum value between the speed of step S4-1-1 and the speed of step S4-1-2. Update the passing time of each position under the tracking train g+1 running with the actual speed.

The embodiments may use the inspiration rules to calculate the driving strategy of following tracking train in the time domain [0, Γ], and update the actual speed and passing time of all trains at each position in the operating range, as well as update the interval running time and delay time at the station. In the end, develop the production trend of multi-train.

Figure 6:
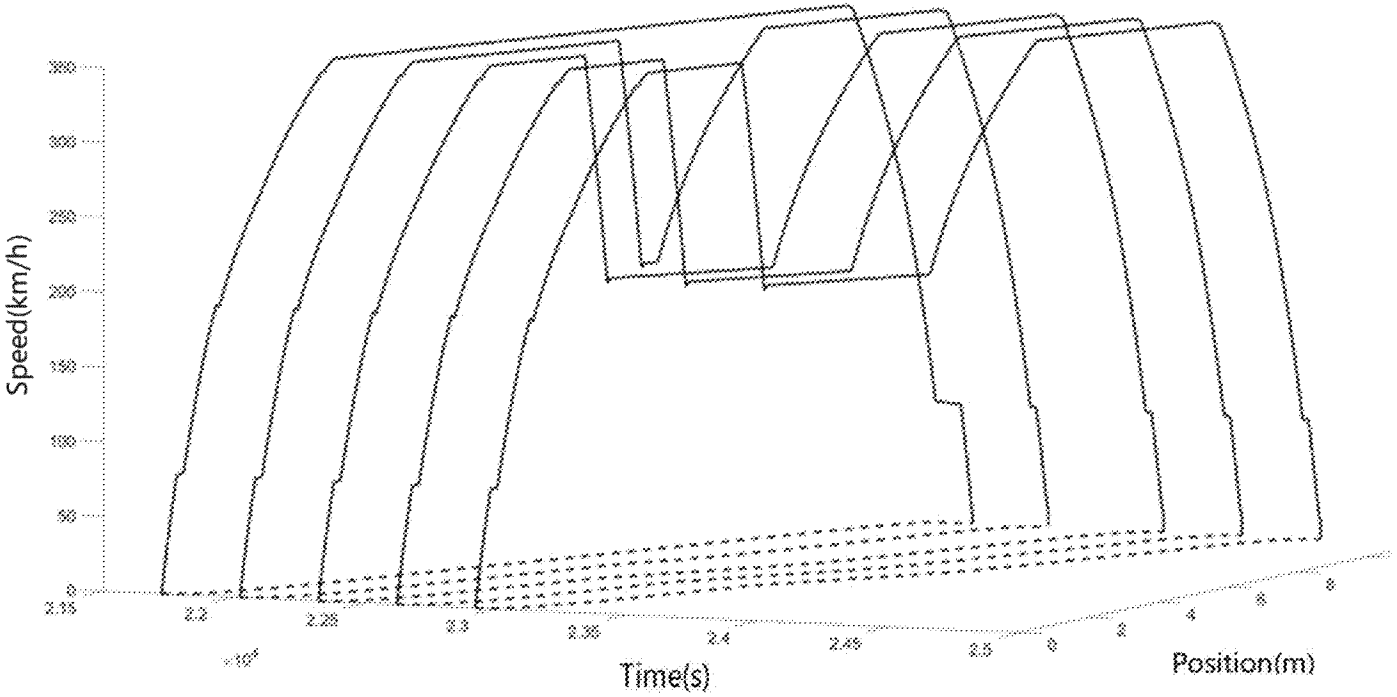
FIG. 6 depicts results of the multi-train operation trend.

Taking a timetable from 6 to 7 o'clock in a certain day of a high-speed railway line in China as an example, the time range of the speed limit section is 6:20 to 6:40, and the space range is 40 kilometers to 60 kilometers from the line, using a quasi-mobile block system, calculate the multi-train operation line and target speed curve under the method of the present invention, as shown in FIG. 6. Among them, multi-train running line (the mid-line in FIG. 6) is the lowest bound to meet the running graph adjustment scheme under the safety tracking distance of multi-train, indicating that the plan adjustment result given by the dispatcher cannot be on the right side of the lowest bound. Similarly, the target speed curve of multi-train (the solid line in FIG. 6) can be used as a speed protection curve for multi-train operation, and the actual operation speed of the train cannot exceed the curve.

Step S5: send the operation trend of multi-train to the driving scheduling platform to assist the scheduler the adjustment phase of the plan; at the same time, the trend information is sent to each train on the line to an optimal driving strategy of the train.

Step S5 specifically includes:

Step S5-1: the RBC decision device outputs multi-train operation trend. The operation trend of multi-train includes at least the acceleration, speed, passing time, interval operation time, and delay time of the train in the future, which is send to the driving scheduling platform by RBC.

Step S5-2: the driving scheduling platform can use the lowest boundary of the running plan adjustment plan under the operation trend of multi-train as the final stage adjustment plan, or adjust phase plan according to the lowest boundary;

Step S5-3: RBC receives information from the train, such as operation data and movement authority, etc., and obtains line parameters from the ground responder;

Step S5-4: RBC sends the static data, the MA, and multi-train operation trend within its jurisdiction. Each train can control the operation in accordance with the target speed curve under the operation trend of multi-train or adjust the driving strategy slightly according to the curve.

In summary, the multi-train operation trend deduction method provided by the present invention allows the dispatchers to adjust the phase plan of multi-train according to the multi-train operation trend. This may reduce the dispatcher's work intensity and improve the emergency response efficiency of railway operation. Train drivers can control the operation safely and punctually according to the target speed curve of multi-train under the operation trend of multi-train.

The present invention also provides a multi-train operation trend deduction device, including the scheduling command module and the train operation control system.

the scheduling command module includes:

An acquisition module, configured to receive temporary speed limit information, scheduling information, line information, and train status information.

A deduction module configured to analyze the coupling relationship between the trains traction calculation and the area of space-time scope which is under temporary speed limit, and calculate the time saving driving strategy of the first train within the time domain; and establish a multi-train operation tracking model under different block systems, according to the running position and speed of the front train; and according to the temporary speed limit information, deduce the driving strategy of following tracking train, and calculate the operation of the multi-train;

A sending module is configured to send the operation trend of multi-train to the driving scheduling platform;

The train operation control system is used to control the running of the train according to the multi-train operation trend.

The above embodiments are only used to illustrate the technical solution of the present invention rather than restrictions on it; although referring to the aforementioned examples of the above-mentioned examples, ordinary technical personnel in the art should understand that they can still be the aforementioned embodiments. The recorded technical solutions are modified, or some of the technical features are replaced. These modifications or replacements do not leave the essence of the corresponding technical solution from the spirit and scope of the embodiment of the embodiments of the invention.

In the end, it should be explained that the present invention is not limited to the above-mentioned optional implementation. Anyone can get other forms of products under the inspiration of the invention. The above-mentioned specific embodiments should not be understood as a limit on the protection of the present invention. The scope of protection of the present invention shall be based on the definition of claims, and the instructions can be used to explain the claims.

The invention claimed is:

1. A multi-train operation trend deduction method, comprising:

step S1: receive, on a wireless device, temporary speed limit information, scheduling information, line information, and train status information;

step S2: calculate a train traction parameter, determine an area of space-time scope comprising one or more locations and one or more time periods which is subject to a temporary speed limit, determine a coupling relationship between the train traction parameter and the area of space-time scope which is under the temporary speed limit, and calculate a time saving driving strategy of a first train within a time domain, comprising calculating multi-train operation trend information of a plurality of trains; to determine acceleration, speed, and passing time of each train in a respective interval;

Step S3: according to a running position and speed of the first train, establish a multi-train operation tracking model under a plurality of different block systems;

wherein, in step S3, the multi-train operation tracking model under different block systems includes:

a calculation formula of $$x_{g+1,\tau}^{EOA}$$

and $$v_{g+1,\tau}^{EOA}$$

under quasi moving block is:

$$\begin{cases} x_{g+1,\tau}^{EOA} = x_{g,\tau-1} - L_{train} - L_{block} - L_{safe} \\ v_{g+1,\tau}^{EOA} = 0 \end{cases} \quad (1)$$

a calculation formula of $$x_{g+1,\tau}^{EOA}$$

and $$v_{g+1,\tau}^{EOA}$$

under moving block-absolute braking is:

$$\begin{cases} x_{g+1,\tau}^{EOA} = x_{g,\tau-1} - L_{train} - L_{safe} \\ v_{g+1,\tau}^{EOA} = 0 \end{cases} \quad (2)$$

a calculation formula of $$x_{g+1,\tau}^{EOA}$$

and $$v_{g+1,\tau}^{EOA}$$

under moving block-relative braking is:

$$\begin{cases} x_{g+1,\tau}^{EOA} = x_{g,\tau} - L_{train} - L_{safe} \\ v_{g+1,\tau}^{EOA} = 0 \end{cases} \quad (3)$$

a calculation formula of $$x_{g+1,\tau}^{EOA}$$

and $$v_{g+1,\tau}^{EOA}$$

under virtual marshalling is:

$$\begin{cases} x_{g+1,\tau}^{EOA} = x_{g,\tau} - L_{train} - L_{safe} \\ v_{g+1,\tau}^{EOA} = v_{g,\tau}^{EOA} \end{cases} \quad (4)$$

wherein $$x_{g+1,\tau}^{EOA}$$

and $$v_{g+1,\tau}^{EOA}$$

represent an end of authority position (EOA) and a speed at a position of the EOA of a respective train g+1 in the plurality of trains at a current moment τ respectively, $$v_{g,\tau}^{EOA}$$

represents a speed at the position of the EOA of a train g in the plurality of trains at a current moment τ, $x_{g,\tau}$ represents the position of the train g in the plurality of trains at the current moment τ, $x_{g,\tau-1}$ represents the position of the train g in the plurality of trains at a moment τ−1, $L_{safe}$ is a distance of safety protection, $L_{block}$ is a distance from the train g in the plurality of trains ahead to a nearest block district, and $L_{train}$ is the length of the train g in the plurality of trains;

step S4: according to the temporary speed limit information, determine a driving strategy for each tracking train in the plurality of trains that is following the first train, and calculate operations of the plurality of trains based on the driving strategy; and step S5: send a multi-train operation trend to a driving scheduling platform and control, with the driving scheduling platform, the operations of the plurality of trains according to the multi-train operation trend by imposing an operation constraint on each of the plurality of trains, wherein the operation constraint is configured to limit each of the plurality of trains to a predetermined degree of adjustment of a driving strategy provided by a target speed curve.

2. The multi-train operation trend deduction method as described in claim 1, wherein the step S2 further comprises:

step S2-1: calculate a running acceleration under a traction state; and step S2-2: generate a first train driving strategy by calculating a first time saving driving strategy to determine first train operation trend information, the first train operation trend information defined over an area starting from a departure station signal machine at a departure station to a next stop of the station signal machine, wherein the first train operation trend information includes, for the first train, acceleration, speed, and passing time information, a running time at the station for the first train, and a delay time arriving station for the first train.

3. The multi-train operation trend deduction method as described in claim 2, wherein the step S2-1 further comprises:

the running acceleration under the traction state is:

$$a = \frac{n_1 \cdot F_{max} - n_2 \cdot B_{max} - R(v) - W}{m} \quad (5)$$

in the formula: $F_{max}$ and $B_{max}$ represent respectively a maximum traction and a maximum brake power; $n_1$, $n_2$ are state parameters, the combination of $n_1$, $n_2$ determines operating conditions, which include traction, cruise, lazy line, and brake; R(v) represents a basic resistance of a train operation, which is related the to train speed v; W represents additional resistance of the train operation, including ramp additional resistance, curve additional resistance, and tunnel additional resistance, and m is train quality.

4. The multi-train operation trend deduction method as described in claim 2, wherein the step S2-2 further comprises:

the calculation formulas of the running acceleration $a_{g,j}$, speed $v_{g,j}$ and passing time $t_{g,j}$ at a current position of the train g are as follows:

$$a_{g,j}=\min\{a, a_{max}\delta_{max}\cdot t_{g,j-1}+a_{g,j-1}\} \quad (6)$$

$$v_{g,j} = \min\left\{V_k, \sqrt{(v_{g,j})^2 + 2 \cdot a_{g,j} \cdot \Delta j}\right\} \quad (7)$$

$$t_{g,j} \doteq t_{g,j-1} + \Delta t_{g,j-1,j} = t_{g,j-1} + \frac{v_{g,j} - v_{g,j-1}}{a_{g,j}} \quad (8)$$

wherein a represents running acceleration in the traction state of the train g, $a_{max}$ represents maximum acceleration, $\delta_{max}$ represents a maximum acceleration change rate, $t_{g,j-1}$ represents a passing time of the train g at a position j−1; $a_{g,j-1}$ represents a running acceleration of the train g at the position j−1; $V_k$ represents a speed limit value in the current speed limit section, $v_{g,j}$ is the speed of train g at the current position j, $v_{g,j-1}$ represents a speed of the train g at the position j−1, Δj represents a distance step length intended to be used for updating the train position, and $\Delta t_{g,j-1,j}$ represents a running time from the position j−1 to the position j of the train g;

wherein a predictive delay time $w_{g,i+1}$ of the train g arrives at the station i+1 is $$w_{g,i+1}=\Delta t_{,i,i+1}-\Delta \bar{t}_{g,i,i+1} \quad (9)$$

in the formula, $\Delta t_{g,i,i+1}$ is the running time of the train g from a station i to a station i+1, $A\bar{t}_{g,i,i+1}$ is a graph of a fixed range running time of the train g in an interval (i,i+1).

5. The multi-train operation trend deduction method as described in claim 4, wherein, the step S4 further comprises determining the driving strategy by:

for a tracking train in the plurality of trains, determining whether or not the temporary speed limit affects operation of the tracking train;

if the temporary speed limit does not affect the operation of the tracking train, under the constraints of a block system EOA, determining the driving strategy of the tracking train by directly reading a saving time driving strategy of the first train under a condition of no temporary speed limit conditions; and if the tracking train is affected by the temporary speed limit, calculating the driving strategy of the tracking train by inspirational rules.

6. The multi-train operation trend deduction method as described in claim 5, further comprising:

determine whether the temporary speed limit affects a following tracking train, if the current moment $\tau$ is in the speed limit section $[t_{left}^{k}, t_{right}^{k}]$, calculate an EOA position $$x_{g+1,\tau}^{EOA}$$

of a tracking train g+1 at the current moment $\tau$, if $$x_{g+1,\tau}^{EOA}$$

is in a range of a spatial scope $[x_{left}^{k}, x_{right}^{k}]$, determining that the tracking train g+1 is affected by the temporary speed limit, and otherwise determining that the tracking train g+1 is not be affected by the temporary speed limit;

wherein k represents a speed limit section k, $[t_{left}^{k}, t_{right}^{k}]$ represents a time range of the speed limit section k, and $[x_{left}^{k}, x_{right}^{k}]$ represents a spatial range of the speed limit section k.

7. The multi-train operation trend deduction method as described in claim 5, wherein calculating the driving strategy of the tracking train by inspirational rules includes:

step S4-1-1: from $x_{g+1,\tau}$ to $x_{g+1,\tau}^{DOA}$, calculate a maximum traction-cruise driving strategy of the tracking train g+1 which is not affected by the temporary speed limit, by applying a saving time driving strategy solution method in step S2-2, wherein $x_{g+1,\tau}$ is a position of the train g+1 at the current time $\tau$, and $$x_{g+1,\tau}^{EOA}$$

is an EOA of the train g+1 at the current time $\tau$;

step S4-1-2: from $x_{g+1,\tau}$ to $x_{g+1,\tau}^{EOA}$ calculate a maximum braking-cruise driving strategy of the tracking train g+1 which is affected by the temporary speed limit, by applying a saving time driving strategy solution method in step S2-2;

Step S4-1-3: determine the actual speed of each position at $[x_{g+1,\tau}, x_{g+1,\tau}^{EOA}]$ of the tracking train g+1 as being equal to the minimum value between the speed of step S4-1-1 and the speed of step S4-1-2, and update the passing time of each position under the tracking train g+1 running with the actual speed.

8. The multi-train operation trend deduction method as described in claim 1, wherein the step S1 further comprises:

receive, from a dispatcher, a dispatching order on the wireless device, the wireless device comprising a wireless block center, and receive, on the wireless device, dispatching information from a train dispatching console, wherein the dispatching order includes temporary speed limit information, line information and train status information, wherein the dispatching information at least includes a time of receiving and departure, and a departure sequence, and the line information at least includes a station kilometer post, a ramp gradient, a curvature, air resistance, a temporary speed limit, and an electric phase separation.

9. The multi-train operation trend deduction method as described in claim 1, wherein the step S5 further comprises:

step S5-1: output, with a radio block center (RBC) unit, a multi-train operation trend, wherein the multi-train operation trend includes at least an acceleration, a speed, a passing time, an interval operation time, and a delay time of a future train, and send, from the RBC unit to the driving scheduling platform;

step S5-2: perform an adjustment with the driving scheduling platform, comprising one of: use a lowest boundary of a running plan adjustment plan under a multi-train operation trend as a final stage adjustment plan, or adjust a phase plan according to the lowest boundary;

step S5-3: receive, on the RBC, operation data and movement authority from the future train, and obtains line parameters from a ground responder;

step S5-4: send, with the RBC, static data, MA, and the multi-train operation trend within its jurisdiction, and control an operation of each train based on data sent by the RBC.

10. A multi-train operation trend deduction device, including the scheduling command module and the train operation control system, the scheduling command module includes:

an acquisition module; configured to receive temporary speed limit information, scheduling information, line information and train status information;

a deduction module; configured to analyze a coupling relationship between a trains traction calculation and an area of space-time scope which is under a temporary speed limit, said area of space-time scope comprising one or more locations and one or more time periods, and calculate a time saving driving strategy of a first train within a time domain; and establish a multi-train operation tracking model under a plurality of different block systems, according to a running position and speed of the first train; and according to temporary speed limit information, determine a driving strategy of a following tracking train, and calculate operation of a plurality of trains;

wherein the multi-train operation tracking model under the plurality of different block systems includes:

a calculation formula of $$x_{g+1,\tau}^{EOA}$$

and $$v_{g+1,\tau}^{EOA}$$

under quasi moving block is:

$$\begin{cases} x_{g+1,\tau}^{EOA} = x_{g,\tau-1} - L_{train} - L_{block} - L_{safe} \\ v_{g+1,\tau}^{EOA} = 0 \end{cases} \quad (10)$$

a calculation formula of $$x_{g+1,\tau}^{EOA}$$

and $$v_{g+1,\tau}^{EOA}$$

under moving block-absolute braking is:

$$\begin{cases} x_{g+1,\tau}^{EOA} = x_{g,\tau-1} - L_{train} - L_{safe} \\ v_{g+1,\tau}^{EOA} = 0 \end{cases} \quad (11)$$

a calculation formula of $$x_{g+1,\tau}^{EOA}$$

and $$v_{g+1,\tau}^{EOA}$$

under moving block-relative braking is:

$$\begin{cases} x_{g+1,\tau}^{EOA} = x_{g,\tau} - L_{train} - L_{safe} \\ v_{g+1,\tau}^{EOA} = 0 \end{cases} \quad (12)$$

a calculation formula of $$x_{g+1,\tau}^{EOA}$$

and $$v_{g+1,\tau}^{EOA}$$

under virtual marshalling is:

$$\begin{cases} x_{g+1,\tau}^{EOA} = x_{g,\tau} - L_{train} - L_{safe} \\ v_{g+1,\tau}^{EOA} = v_{g,\tau}^{EOA} \end{cases} \quad (13)$$

wherein $$x_{g+1,\tau}^{EOA}$$

and $$v_{g+1,\tau}^{EOA}$$

represent EOA and a speed at the position of the EOA of a train g+1 at the current moment τ respectively, $$v_{g,\tau}^{EOA}$$

represents a speed at a position of the EOA of a train g at the current moment τ, $x_{g,\tau}$, represents a position of a train g at the current moment τ, $x_{g,\tau-1}$ represents a position of the train g at a moment τ−1, $L_{safe}$ is a distance of safety protection, $L_{block}$ is a distance from the train g ahead to a nearest block district, $L_{train}$ is a length of the train;

a sending module; configured to send the multi-train operation trend to a driving scheduling platform;

wherein the train operation control system is used to control the operation of a plurality of trains according to the multi-train operation trend by imposing an operation constraint on each of the plurality of trains, wherein the operation constraint is configured to limit each of the plurality of trains to a predetermined degree of adjustment of a driving strategy provided by a target speed curve.

* * * * *